US012043465B2

(12) United States Patent
Wyser et al.

(10) Patent No.: US 12,043,465 B2
(45) Date of Patent: Jul. 23, 2024

(54) TEAR-OPEN POUCH THAT STAYS IN ONE PIECE AFTER OPENING

(71) Applicant: SOCIETE DES PRODUITS NESTLE S.A., Vevey (CH)

(72) Inventors: Yves Roger Wyser, Forel (CH); Fanny Claire Emmanuelle Chevet-Douelle, Lausanne (CH)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 17/758,732

(22) PCT Filed: Jan. 7, 2021

(86) PCT No.: PCT/EP2021/050159
§ 371 (c)(1),
(2) Date: Jul. 13, 2022

(87) PCT Pub. No.: WO2021/144182
PCT Pub. Date: Jul. 22, 2021

(65) Prior Publication Data

US 2023/0072961 A1 Mar. 9, 2023

(30) Foreign Application Priority Data

Jan. 15, 2020 (EP) ..... 20151961

(51) Int. Cl.
*B65D 75/58* (2006.01)
*B65D 75/42* (2006.01)
*B65D 75/44* (2006.01)

(52) U.S. Cl.
CPC ..... *B65D 75/5805* (2013.01); *B65D 75/42* (2013.01); *B65D 75/44* (2013.01)

(58) Field of Classification Search
CPC ..... B65D 75/42; B65D 75/44; B65D 75/5805
(Continued)

(56) References Cited

U.S. PATENT DOCUMENTS 2,071,926 A * 2/1937 Geerlings ..... B32B 27/00 229/87.05
3,480,198 A * 11/1969 Repko ..... B65D 75/5805 383/203

(Continued)

FOREIGN PATENT DOCUMENTS

DE 29719686 1/1998
JP H09164626 A 6/1997

(Continued)

OTHER PUBLICATIONS

Russian Office Action from corresponding Russian Patent Application No. 2022119329/11, dated Feb. 29, 2024. 6 pages.

(Continued)

*Primary Examiner* — Peter N Helvey
(74) *Attorney, Agent, or Firm* — K&L Gates LLP

(57) ABSTRACT

The present invention relates generally to the field avoiding the disposal of small pieces of packaging material into the environment. In particular, the present invention relates to flexible pouches. Proposed are flexible tear-open pouches that after opening stay in one piece. This avoids that the small torn-off pieces of packaging are disposed into the environment after opening. Embodiments of the present invention relate to a flexible pouch that is sealed with seals and on the back of the pouch with a finseal, and that comprises a tear starting point that is located essentially opposite of the finseal.

14 Claims, 3 Drawing Sheets

(58) Field of Classification Search
USPC ..... 383/200
See application file for complete search history.

(56) References Cited

U.S. PATENT DOCUMENTS

| | | | | |
|---|---|---|---|---|
| 3,873,735 | A * | 3/1975 | Chalin | B65D 75/58 229/123.1 |
| 6,244,467 | B1 * | 6/2001 | Lewit | B65D 55/16 222/541.6 |
| 6,702,462 | B2 * | 3/2004 | Richardson | B65D 75/5811 222/541.6 |
| 7,891,875 | B1 | 2/2011 | Feldman | |
| 11,554,038 | B2 * | 1/2023 | O'Flynn | A61F 5/451 |
| 11,603,243 | B2 * | 3/2023 | Takigawa | B65D 75/5827 |
| 2001/0014187 | A1 * | 8/2001 | Takahashi | B29C 66/83513 383/200 |
| 2003/0152300 | A1 * | 8/2003 | Tu | B65D 75/5811 383/207 |
| 2015/0353239 | A1 * | 12/2015 | Tan | B65D 33/065 493/194 |

FOREIGN PATENT DOCUMENTS

| | | | |
|---|---|---|---|
| JP | H10151715 | A | 6/1998 |
| KR | 20160149166 | | 12/2016 |
| KR | 1020160149166 | | 12/2016 |
| WO | 2015081084 | A2 | 6/2015 |
| WO | 2017089896 | A1 | 6/2017 |

OTHER PUBLICATIONS

Japanese Office Action from corresponding Japanese Patent Application No. 2022-542295, dated Apr. 2, 2024. 6 pages.

* cited by examiner

TEAR-OPEN POUCH THAT STAYS IN ONE PIECE AFTER OPENING

CROSS REFERENCE TO RELATED APPLICATIONS

The present application is a National Stage of International Application No. PCT/EP2021/050159, filed on Jan. 7, 2021, which claims priority to European Patent Application No. 20151961.8, filed on Jan. 15, 2020, the entire contents of which are being incorporated herein by reference.

FIELD OF THE INVENTION

The present invention relates generally to the field avoiding the disposal of small pieces of packaging material into the environment. In particular, the present invention relates to flexible pouches. Proposed are flexible tear-open pouches that after opening stay in one piece. This avoids that the small torn-off pieces of packaging are disposed into the environment after opening. Embodiments of the present invention relate to a flexible pouch that is closed with seals on both ends and on the back of the pouch (finseal), and that comprises a tear starting point that is located essentially opposite of the finseal.

BACKGROUND OF THE INVENTION

Packaging waste is one of the sustainability issues the world is facing today. To address this issue, packaging material is increasingly produced so that it can be re-used or recycled after use. Unfortunately, not every recyclable packaging material is actually recycled today. Flexible tear-off pouches, such as stick packs, for example, are used frequently in packaging, and their usage grows. They offer several advantages as they are safe, convenient, portable, useful for single servings and save packaging material compared to other packaging options.

However, opening a tear-off pouch, for example a single-serve tear-off pouch, leaves the consumer with a small torn-off piece of packaging material and an open pouch filled with product. Often, the small torn-off piece of packaging material is then quickly disposed while the remaining part of the pouch is properly disposed after emptying to allow for recycling. The small torn-off part of packaging material, however, may end up in the garbage where it cannot be recycled, or simply in the environment. For example, WO201789896 A1 and WO2015/081084 disclose stick packs, which after opening result in a torn-off piece of packaging material and an open packaging containing the product.

Typical tear-open stick packs are made from a single piece of packaging material that is folded and sealed at the top and bottom end with a cross seal, and on the back the two sides of the packaging material are connected with a finseal. This results in a stick pack with the finseal on the back. The tear starting point is then located at one side of the stick pack, so that when the stick pack is opened, the tearing will already stop in the middle of the pack due to the finseal, and it will be difficult to empty the stick pack completely. To avoid this, consumers usually force the tearing through the finseal resulting in a separate small piece of packaging that often is discarded in a way that it does not properly enter the recycling stream.

DE202018106857 U1 discloses a packaging bag made of flexible plastic material, comprising at least two bag walls and having at least two side edges, with a defined line of weakness configured for controlled tearing of the packaging starting at a tear-starting point located within a side edge where the bag walls are attached to one another, wherein in the extension of the direction of the line of weakness is a tear-stop assembly configured for stopping a crack propagation.

The packaging bag described in this document uses a tear-stop assembly to stop the propagation of the tear. The introduction of such a tear-stop assembly introduces complexity into the packaging bag. This results in increased costs for packaging, which might make the packaging not useable for packing products with a lower price.

It would therefore be desirable to provide the art with a flexible pouch that can be, for example, a stick-pack made from one piece of material and sealed at the ends with seals and on the back with a finseal, that can be fully torn open without resulting in two pieces of packaging.

Any reference to prior art documents in this specification is not to be considered an admission that such prior art is widely known or forms part of the common general knowledge in the field.

The objective of the present invention was to improve the state of the art and, in particular, to provide a flexible pouch that is simple and cost-efficient to manufacture, that is to be torn open, that after opening results in one piece of packaging material and avoids that a small piece of packaging is torn off, and that after opening results in an opening that is sufficiently large, for example, that extends essentially across a complete side of the flexible pouch, or to at least provide a useful alternative.

SUMMARY OF THE INVENTION

The inventors were surprised to see that the object of the present invention could be achieved by the subject matter of the independent claim. The dependent claims further develop the idea of the present invention.

Accordingly, the present invention provides a flexible pouch that is sealed with seals and on the back of the pouch with a finseal, comprising a tear starting point wherein the tear starting point is located essentially opposite of the finseal.

As used in this specification, the words "comprises", "comprising", and similar words, are not to be interpreted in an exclusive or exhaustive sense. In other words, they are intended to mean "including, but not limited to".

The present inventors have shown that when using the flexible pouch in accordance of the present invention with the finseal located essentially opposite the tear starting point, the tearing open of the flexible pouch is stopped at the finseal, so that no part of the packaging is torn off, while the resulting opening extends essentially across the complete side of the flexible pouch, allowing for convenient emptying of the product from the pouch.

Hence, the present invention relates to a flexible pouch that is closed with top and bottom seals and on the back of the pouch with a finseal, comprising a tear starting point, characterized in that the tear starting point is located essentially opposite of the finseal.

DETAILED DESCRIPTION OF THE INVENTION

Figure 1:
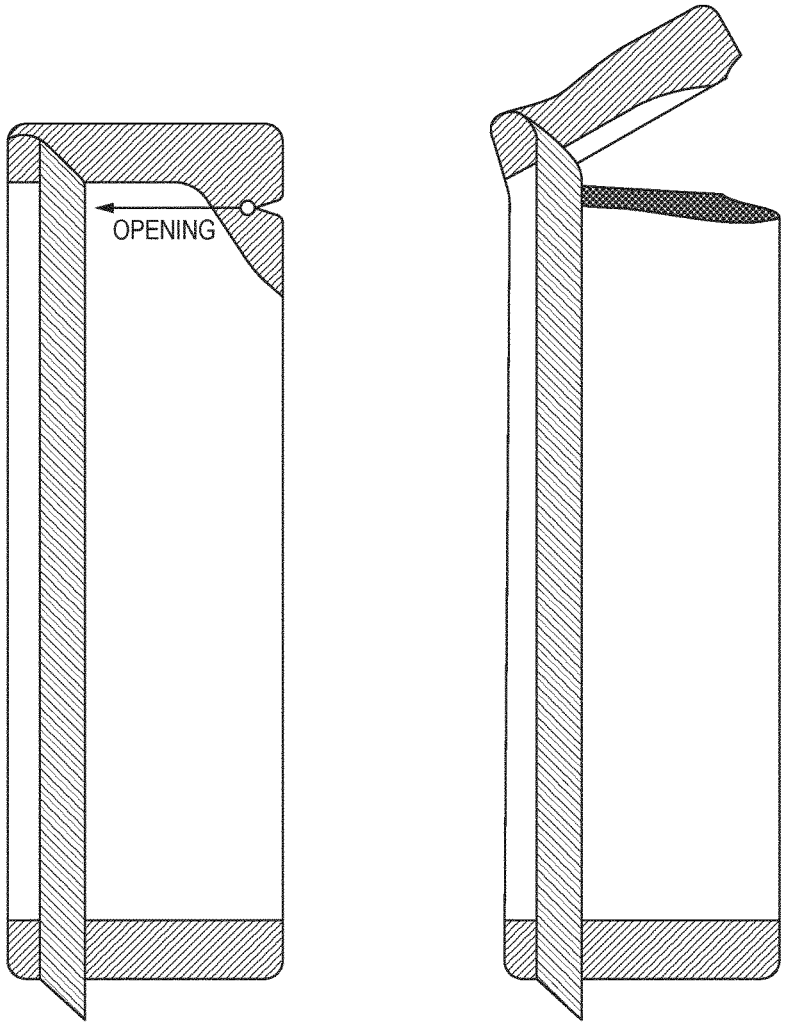
FIG. 1 shows one embodiment of the flexible pouch in accordance with the present invention in an opened state and in a closed state.

Consequently, the present invention relates in part to a flexible pouch that is sealed with seals and on the back of the pouch with a finseal, comprising a tear starting point, characterized in that the tear starting point is located essentially opposite of the finseal.

For example, the flexible pouch may be closed with a top and a bottom seal and on the back of the pouch with a finseal, and may comprise a tear starting point characterized in that the tear starting point is located essentially opposite of the finseal.

For the purpose of the present invention, a flexible pouch is a pouch made from flexible material. For example, a flexible material may be a material capable of bending without breaking. Further, for example, such a flexible material may be a material that can be bent without breaking by hand.

A pouch may be a container for a product, for example a powder, a granulate, a gel or a liquid, such as a bag, a sack, or another receptacle suitable for these purposes. Often pouches are used for smaller quantities, such as for single servings, for example.

The flexible pouch is closed with seals. Except for the finseal of the flexible pouch, the pouch may be sealed with any seal known in the art and suitable for packaging the product the pouch is intended to be used for. Such a seal may be a cross-seal, for example. Cross-seals are well-known in the art. For example, a cross seal may be described as a seal performed by a bagger perpendicularly to the direction of movement of the packaging material.

For example, the flexible pouch in accordance with the present invention may have an elongated shape. Typical embodiments of flexible pouches with an elongated shape in accordance with the present invention may have an oval or rectangular shape, for example.

Hence, in one embodiment of the present invention, the flexible pouch has an elongated shape, and is sealed on two shorts ends with seals, for example with cross-seals and on the back of the pouch with a finseal.

For example, the flexible pouch in accordance with the present invention is a stick pack.

A fin-seal is well-known in the art. A fin seal may be described as a seal that results when superimposed edges of at least one sheet are bonded, resulting in a pouch having fin-like protuberances.

As tear starting point, any tear starting point known to the person skilled in the art can be used. Typically, such a tear starting point may be a small weakness in the packaging material, or a small hole in the packaging material that is underlayed with another material that tears easily. A tear starting point may also comprise or consist of a visual indication on the pouch. The tear starting point may also be a tear notch. For example, tear notches may be applied to the upper left corner of the pouch to accommodate right-handed consumers, who tear from left to right. Such a tear notch can be a small incision. This incision may have a triangular form, for example. Often, areas to be notched are first sealed, and then the notch is made in the sealed area. Hence, a tear starting point may be selected from the group consisting of weaknesses in the packaging material, tear notches, scores, visual indications on the pouch, or combinations thereof. Visual indications on the pouch may be printed or embossed, for example.

The tear starting point is located essentially opposite of the finseal. This is in contrast to state of the art pouches, where the tear starting point is usually located in the upper left corner of the pouch with the finseal located in the middle of the back of the pack. "Essentially opposite" of the finseal may mean for the purpose of the present invention that if the finseal is located at 0° of the circular cross section of the pouch, the tear starting point is located between 120° and 240°, for example, between 155° and 205°; for example, between 165° and 195°; further for example, between 175° and 185° of the circular cross section of the pouch. The inventors were surprised to see that a particular good tear resistance was obtained when the tear starting point was located between about 120° and 175° or between about 185° and 240° of the circular dross section of the pouch if the finseal is located at 0° C. A circular cross-section is the cross-section of the pouch that is obtained, if the pouch is held and compressed so that a circular cross-section is obtained. The inventors were further surprised to see that a particular good tear resistance was obtained when the finseal is oriented opposite the tear direction.

In one embodiment of the present invention, the seal on at least one side the flexible pouch of the present invention is a cross seal that is wider at the side of the pouch opposite the finseal that at the side of the finseal, and the tear starting point is located within the cross seal at a position that allows it that the tearing will be across an unsealed part of the pouch. For this, the tear starting position may be located within the cross seal essentially opposite of the finseal and at a position below the end of the cross seal at the side of the finseal, if the tear starting position is located at the top of the packaging. If the tear starting position is located at the bottom of the packaging, the tear starting position may be located within the cross seal essentially opposite of the finseal and at a position above the end of the cross seal at the side of the finseal.

To avoid that opening the pouch of the present invention results in tearing-off a piece of the packaging, a tearing stop position can be used. The person skilled in the art knows typical tearing-stop positions that can be used. Such tearing stop positions may be selected from the group consisting of an incision essentially orthogonal to the tearing direction that will stop the tearing process, a piece of extra rigid material in the packaging that will stop the tearing process, or an extra piece of packaging material applied to the outside or inside of the packaging in the direction of the tearing process that will stop the tearing process.

One advantage of the subject matter of the present invention is, however, that no extra tearing stop position is required. Instead, the finseal will serve as tearing stop position. Hence, in one embodiment of the present invention, the flexible pouch does not comprise an extra tearing stop position other than the finseal. This has the advantage that the pouch is easy to produce and no further modification of the packaging material except sealing is required. This eliminates costs and the risk of introducing error sources or weaknesses into the pouch of the present invention.

To ensure an optimal protection of the product to be packaged in the pouch of the present invention, the pouch may be made of one piece of material. This makes it possible that an optimal protection of the packaged product can be achieved by sealing the packaging material only at three sides, top, bottom and back, while pouches made from two pieces of material typically require sealing at all four sides, or in case of a round shape all around the round shape. As any seal is a potential risk for a leak, reducing the number of seals is beneficial for the simple and safe packaging of products in flexible pouches. Hence, the flexible pouch in accordance with the present invention may be made from one piece of material.

To avoid spillage of the material packaged in the pouch of the present invention it may be preferred, if the tear starting point is located near the end of the pouch. If the content of the pouch is to be poured from the top of the pouch, it is preferred if the tear starting point is located near the upper end of the pouch. Ideally, the tear starting point is located above the filling line of the pouch, but below the upper seal, so that after opening the pouch by tearing it open starting from the tear starting point, no product is spilled, and the release of the product is only triggered, if the pouch is tilted, so that the product can be poured from the pouch. This is in particular useful, if the product packaged in the pouch of the present invention is a liquid, a powder, agranulate or a gel, for example. Alternatively, if the product is to be released from the pouch without tilting the pouch, it may be preferred if the tear starting point is located near the lower end of the pouch. This way, the product in the pouch of the present invention will be released immediately, when the pouch is torn open. Consequently, in one embodiment of the present invention, the tear starting point is located near the upper end or lower end of the pouch, for example within the first or last quarter of the length of the pouch. Further, for example, the tear starting point may be located near the upper end or lower end of the pouch, for example within the first or last fifth, sixth, seventh or eighth of the length of the pouch.

For certain applications of the pouch of the present invention, it may be preferred, if tearing open of the pouch does not extend freely from the tear starting point, but is guided. This way, it can be ensured that the pouch is always torn open along the same line. As a consequence, design elements on the pouch can be protected during the opening operation. Further, it can be ensured that opening always occurs along a foreseen line, resulting in a uniform opening of all pouches. This may have advantages. For example, easy emptying of the pouch can be ensured, unwanted product spilling can be avoided and/or an iconic opening pattern can be implemented. Hence, in the pouch of the present invention, a line guiding the tearing may be extending from the tear starting point at least partially across the pouch, for example, essentially parallel to the upper and/or lower edge of the pouch, ending at the latest before or within the finseal. For the purpose of the present invention, the term "essentially parallel" shall mean at an angle of maximal 25°, of maximal 20°, of maximal 15°, of maximal 10°, or of maximal 5°. The line guiding the tearing may be, for example, a scoring line or a line along which the packaging material has a weakness, so that the tearing will be guided along the line guiding the tearing. For example, the line guiding the tearing may be extending in a way at least partially across the pouch so that the tear starting point is located closer to the upper end of the pouch than the position where the tearing ends, so that after tearing a spout is formed at the upper end of the pouch to eject the content of the pouch. Further, for example, the line guiding the tearing may be extending in a way at least partially across the pouch so that the tear starting point is located closer to the bottom end of the pouch than the position where the tearing ends, so that after tearing a spout is formed at the bottom end of the pouch to eject the content of the pouch. The formation of a spout is an example, how a line guiding the tearing can ensure easy emptying of the pouch and avoid unwanted product spilling.

It is one advantage of the present invention that in the operation of tearing open the flexible pouch of the present invention no piece of material is torn off the packaging. As the tearing starts essentially opposite the finseal, it is possible to open the pouch wide enough without having to rip through the finseal as in pouches of the prior art. For example, the pouch may be opened by tearing open the pouch without allowing the tear to arrive at the finseal. Even if opened in a hurry and with too much force, the finseal will stop the tearing at the latest, so that the pouch is fully opened, but the torn off part stays attached to pouch via the finseal. Hence, in one embodiment of the present invention, in the flexible pouch of the present invention after tearing the pouch open, the teared-off fraction of the pouch stays attached to the pouch through the finseal.

It may be preferred to make it even more unlikely that the finseal is torn in two during the opening operation, if the pouch is opened with too much force. To achieve this, the finseal or a part thereof that is located essentially opposite the tear starting point may be reinforced to avoid that the finseal can be torn in two at that position. For example, in the flexible pouch of the present invention the finseal of the pouch may comprise a strengthening element that avoids that when tearing open the pouch the tear accidentally crosses the seal on the back of the pouch. Such a strengthening element may be, for example, an additional tear resistant packaging layer that is introduced into the finseal.

The flexible pouch of the present invention can be manufactured from any material known to the person skilled in the art that is suitable to manufacture flexible pouches. For example, the pouch may be made from a material selected from the group consisting of paper, plastics, aluminum, combination materials or combinations thereof. Such combination materials may be obtained by lamination, extrusion coating, dispersion coating or other technologies known to the person skilled in the art.

In view of ensuring sustainability and a protected environment, it would be desirable if packaging material used today had an as little impact on the environment as possible. In view of this it is preferred if the pouch of the present invention was made from a recyclable, biodegradable and/or compostable material.

The shape of the flexible pouch in accordance of the present invention is not particularly limited. However, a pouch with a finseal is preferably made from one piece of material. Typically, the pouch is sealed at the top and at the bottom and with a finseal on the back. Often, the top and the bottom of the pouches are the short ends of the pouch, while the finseal extends along the length of the pouch. In one embodiment of the present invention, the pouch may have an essentially rectangular shape with the short edges having about 10 to 70%, of about 15-50%, or about 20-30% of the length of the long edges. For the purpose of the present invention, the term "essentially rectangular" shall mean that the angles in the essentially rectangular shape have sizes in the range of 70° 410°, in the range of 75°-105°, in the range of 80°-100°, or in the range of 85°-95°. In one embodiment, the pouch has a rectangular shape.

The size of the flexible pouch in accordance with the present invention is not particular limited. Feasible are large pouches, for example pouches intended to refill existing packages. The pouches may contain single or multiple servings. However, it has become evident that the problem with incorrectly disposed packaging parts is most frequent in packages that contain smaller amounts of product, for example, an amount of product intended to be used in a single use operation. Hence, for example, the pouch may be designed to contain a product weight in the range of 1 to 250 g, 1 to 100 g or 1 to 50 g. Further, for example, the pouch may contain an amount of product intended for a single use, for example a single serving.

The pouch of the present invention may be used to package products intended for consumption by a subject. The subject may be a human or an animal, for example a pet and/or a companion animal. The product intended for consumption by a subject may be a food product, a pet food product, a nutritional supplement or a medicament, for example. In one embodiment, the pouch is to be used to package food products. For the purpose of the present invention, the term "food" shall mean in accordance with Codex Alimentarius any substance, whether processed, semi-processed or raw, which is intended for human consumption, and includes drink, chewing gum and any substance which has been used in the manufacture, preparation or treatment of "food" but does not include cosmetics or tobacco or substances used only as drugs.

The pouch of the present invention may be used and distributed as single pouches. This would allow consumers, for example, to purchase environmentally friendly packaged products as single servings. Alternatively, the pouches may be attached to one another via the sides of the pouch. This way products packaged in the pouch of the present invention can be provided to consumers in a way that the single serve pouches are attached to one another. For example, these pouches attached to one another can form a chain. During purchase, the consumer can then tear off one or more of the individual pouches from the chain of the pouches. Ideally, the pouches are attached to on another via the short ends. This decreases the likelihood that pouches are accidentally opened when single pouches ore torn off the chain. Hence, in one embodiment the pouch is provided as a plurality of pouches attached to one another at the short edges via an attachment means that allows tearing off individual pouches. Here it is preferred that the attachment means is easier to separate than it is to open the pouch from the tear starting point to avoid unintentional opening of the pouches.

Those skilled in the art will understand that they can freely combine all features of the present invention disclosed herein. Further, features described for different embodiments of the present invention may be combined.

Although the invention has been described by way of example, it should be appreciated that variations and modifications may be made without departing from the scope of the invention as defined in the claims.

Furthermore, where known equivalents exist to specific features, such equivalents are incorporated as if specifically referred in this specification. Further advantages and features of the present invention are apparent from the figures and non-limiting examples.

EXAMPLES

Figure 2:
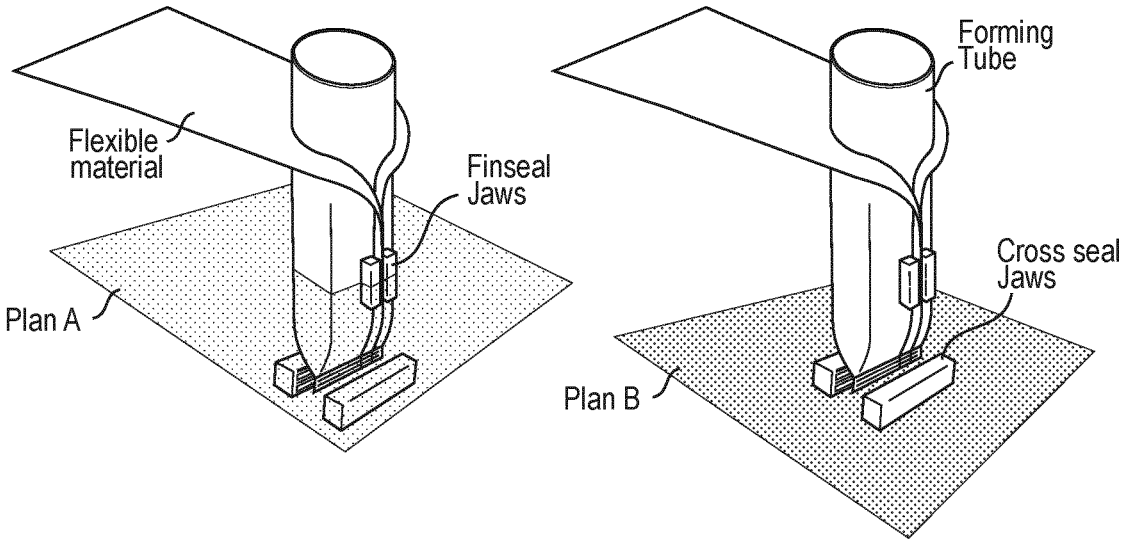
FIG. 2 illustrates how a flexible pouch in accordance with the present invention can be manufactured.
Figure 2:
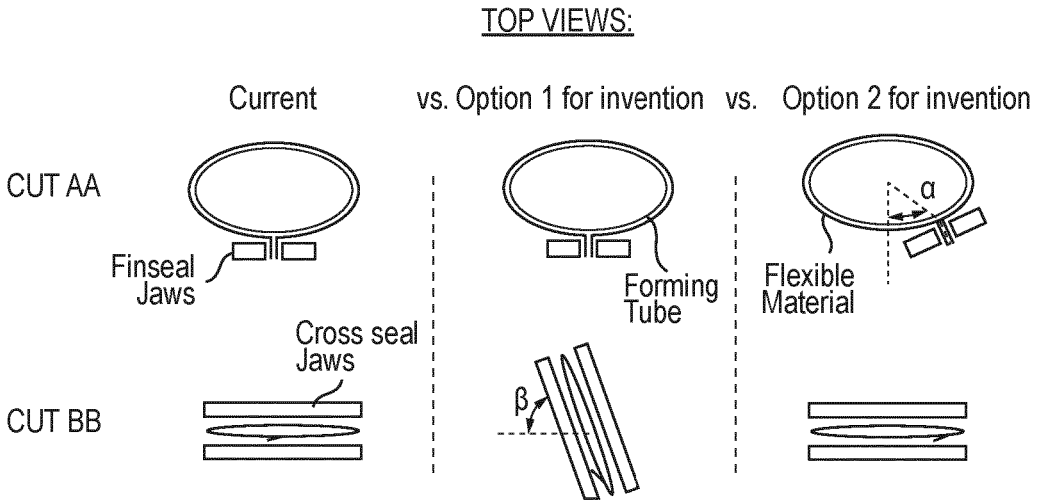
Figure 3:
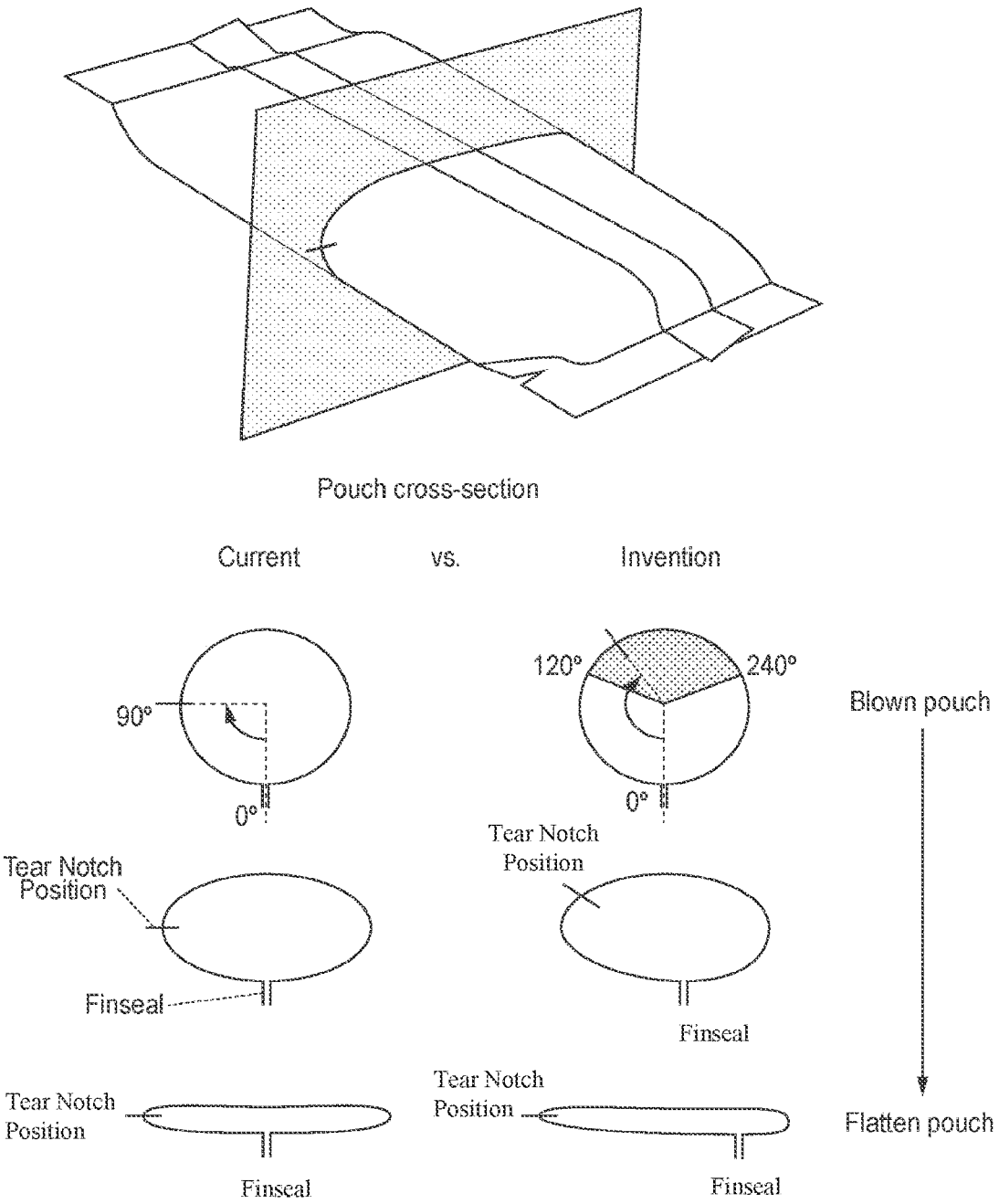
FIG. 3 illustrates an example of a difference between the flexible pouch in accordance with the present invention and a stick pack as currently used.

Elongated shape packs where created on a lab sealer, (HSG-CC Heat-sealing machine, Brugger Feinmechanik GmbH, Munich, Germany) using the appropriate sealing conditions of temperature, pressure (clamping force) and time to obtain a proper seal when applied to the different materials. Flat sealing jaws of 5 mm width were used for all experiments. FIG. 2 illustrates how the flexible pouch in accordance with the present invention can be manufactured.

Materials:

Paper: 60 grams per square meter, coated with 8 grams per square meter functional polymer-based dispersion coatings, including a sealant layer Polymer based laminate: multilayer laminate composed of a layer of polyethylene terephthalate (PET) as external layer (12 μm), a layer of aluminium (20 μm) and a layer of polyethylene (70 μm) as sealing layer.

Sealing Conditions:

| | Paper | Laminate |
|---|---|---|
| Temperature (both sides) | 115° C. | 130° C. |
| Clamping force | 400N | 400N |
| Clamping time | 0.5 s | 0.5 s |

Sample Preparation

Rectangles with the following dimensions were cut from the materials:

75 mm×120 mm

The two short edges of the film were superposed, without marking the fold and sealed as close as possible to the edge, forming the fin seal of the final package.

The obtained cylinder was then flattened, with the finseal placed at different distances from the fold, i.e. 0, 5 8 and 17 mm of the edge. In some cases, the finseal was oriented towards the center of the pouch, in other cases towards the edge. The cylinder was then sealed on both short ends, yielding samples resembling stickpacks.

The angle between the tear starting point and the finseal was obtained by calculation. The Table below summarizes the prepared samples and provides their code. Each sample was prepared in duplicates (except Pap17 and Pap17O which were prepared only once), providing each 2 opening possibility (one in each side).

| Code | Material | Fin seal distance from edge opposite the tear starting point | Calculated angle | Orientation of finseal |
|---|---|---|---|---|
| Pap0 | Paper | 0 mm | 180° | Towards center |
| Pap5 | Paper | 5 mm | 163° | Towards center |
| Pap8 | Paper | 8 mm | 153° | Towards center |
| Pap17 | Paper | 17 mm | 123° | Towards center |
| Pap17O | Paper | 17 mm | 57° (tearing direction opposite to Pap 17) | Towards center |
| Pap8O | Paper | 8 mm | 153° | Towards edge |
| Lam0 | Laminate | 0 mm | 180° | Towards center |
| Lam5 | Laminate | 5 mm | 163° | Towards center |
| Lam17 | Laminate | 17 mm | 123° | Towards center |
| Lam8O | Laminate | 8 mm | 153° | Towards edge |

Opening Behaviour Evaluation

A 2 mm notch was cut using a cutter at approximately 5 mm form the seal towards the middle of the sample, representing the tear starting point. This was done on each side of the sample.

Evaluators were asked to tear the samples open, at a speed so that the opening would take between approximately 1-2 seconds, without looking at the sample during the action. They were asked to stop when a clear increase in opening resistance was observable.

| Code | Side | Evaluator 1 | Comments | Evaluator 2 | Comments |
|---|---|---|---|---|---|
| Pap0 | 1 | Opening stopped | Might depend on whether finseal is facing user or not (potentially linked to use by left handed vs right handed user. | Opening stopped | |
| | 2 | Opening not stopped | | Opening stopped | |
| Pap5 | 1 | Opening stopped | | Opening stopped | |
| | 2 | Opening stopped | | Opening not stopped | A clear resistance was felt. |
| Pap8 | 1 | Opening stopped | | Opening stopped | |
| | 2 | Opening stopped | | Opening stopped | |
| Pap17 | 1 | Opening stopped | | Opening stopped | |
| Pap17O | 1 | Opening not stopped | | Opening not stopped | |
| Pap8O | 1 | Opening stopped | | Opening stopped | |
| | 2 | Opening stopped | | Opening not stopped | |
| Lam0 | 1 | Opening not stopped | Weak resistance increase felt but not sufficient to stop opening | Opening not stopped | Weak resistance increase felt but not sufficient to stop opening |
| | 2 | Opening not stopped | | Opening not stopped | |
| Lam5 | 1 | Failed (tear deviated in cross seal) | | Opening stopped | |
| | 2 | Opening stopped | | Opening stopped | |
| Lam17 | 1 | Opening stopped | | Opening stopped | |
| | 2 | Opening stopped | | Opening stopped | |
| Lam8O | 1 | Opening stopped | | Opening stopped | |
| | 2 | Opening stopped | | Opening stopped | |

From the above, it can be concluded that:

The invention is effective, even with materials with very low tear strength (paper)

Preferably, the finseal should be oriented opposite the tear direction, especially with materials with low tear strength such as papers (Pap8O and Pap17O)

Best results were obtained if the tear starting point was located between about 120° and 175° or between about 185° and 240° of the circular dross section of the pouch if the finseal is located at 0° C.

The invention claimed is:

1. A flexible pouch that is closed with a top seal, a bottom seal, and on the back of the flexible pouch with a finseal, the flexible pouch comprising:

a tear starting point, wherein the tear starting point is located opposite of the finseal, and the finseal of the flexible pouch comprises a strengthening element that is configured to avoid a tear accidentally crossing the finseal on the back of the flexible pouch when the flexible pouch is being torn open, wherein the strengthening element comprises a tear resistant packaging layer in the finseal, wherein the tear starting point is selected from the group consisting of a weakness in packaging material of the pouch, a tear notch, a score, a visual indication on the pouch, and combinations thereof; and the tear starting point is located within the top seal, with an unsealed part of the pouch positioned between the tear starting point and the finseal;

wherein a line guiding the tearing extends from the tear starting point at least partially across the flexible pouch; wherein a portion of the line guiding the tearing extends from the top seal and intersects with the finseal, and the portion of the line guiding the tearing that extends from the top seal and intersects with the finseal is positioned completely within the unsealed portion of the pouch.

2. The flexible pouch in accordance with claim 1, wherein the tear starting point is located between about 120° and 175° from the finseal, and wherein the finseal is oriented opposite a tear direction.

3. The flexible pouch in accordance with claim 1, wherein the flexible pouch does not comprise an extra tearing stop position other than the finseal.

4. The flexible pouch in accordance with claim 1, wherein the flexible pouch is made from one piece of material.

5. The flexible pouch in accordance with claim 1, wherein the tear starting point is located near an upper end or a lower end of the flexible pouch.

6. The flexible pouch in accordance with claim 1, wherein after tearing the flexible pouch open, the teared-off fraction of the flexible pouch is configured to stay attached to the flexible pouch through the finseal.

7. The flexible pouch in accordance with claim 1, wherein the flexible pouch is made from a material selected from the group consisting of paper, plastics, aluminum, or combinations thereof obtained by lamination, extrusion coating, dispersion coating and other technologies.

8. The flexible pouch in accordance with claim 1, wherein the flexible pouch is made from a recyclable, biodegradable, and compostable material.

9. The flexible pouch in accordance with claim 1, wherein the flexible pouch has an rectangular shape including short edges and long edges, with a length of the short edges being about 10 to 70% of a length of the long edges.

10. The flexible pouch in accordance with claim 1, wherein the flexible pouch is designed to contain a product weight in the range of 1 to 250 g.

11. The flexible pouch in accordance with claim 1, wherein the flexible pouch contains food products.

12. The flexible pouch in accordance with claim 1, wherein the flexible pouch is part of a plurality of flexible pouches, wherein each of the plurality of flexible pouches includes first edges and further includes second edges that are shorter than the first edges, and wherein each of the plurality of flexible pouches is attached to another of the plurality of flexible pouches at one of the short edges via an attachment configured to allow tearing off of each of the plurality of flexible pouches.

13. The flexible pouch in accordance with claim 1, further comprising a tearing stop position.

14. The flexible pouch in accordance with claim 13, wherein the tearing stop position consists of one of an incision orthogonal to a tearing direction, a piece of rigid material in the tearing direction, or a piece of packaging material applied to an outside or an inside of the flexible pouch in the tearing direction.

* * * * *